US007861881B2

(12) United States Patent
Ali et al.

(10) Patent No.: US 7,861,881 B2
(45) Date of Patent: Jan. 4, 2011

(54) REMOVABLE OVERCAP FOR MICROWAVEABLE PACKAGED GOOD ARTICLE

(75) Inventors: El-Afandi Ali, Maplewood, MN (US); Larche Glen, Malvern, PA (US)

(73) Assignee: General Mills Cereals, LLC., Minneapolis, MN (US)

( * ) Notice: Subject to any disclaimer, the term of this patent is extended or adjusted under 35 U.S.C. 154(b) by 0 days.

(21) Appl. No.: 11/437,844

(22) Filed: May 19, 2006

(65) Prior Publication Data

US 2006/0266751 A1 Nov. 30, 2006

Related U.S. Application Data

(63) Continuation-in-part of application No. 11/261,110, filed on Oct. 28, 2005.

(60) Provisional application No. 60/622,892, filed on Oct. 28, 2004.

(51) Int. Cl.
*B65D 51/12* (2006.01)

(52) U.S. Cl. ..... 220/305; 220/380; 220/780; 206/508

(58) Field of Classification Search ..... 220/376, 220/258.2, 258.1, 780, 380, 367.1, 359.2, 220/256.1, 258.3, 671, 797, 305, 287, 784; 206/508

See application file for complete search history.

(56) References Cited

U.S. PATENT DOCUMENTS 2,533,159 A 10/1948 Yates
2,947,463 A * 8/1960 Conklin ..... 229/404
3,179,283 A * 4/1965 Amberg ..... 220/781
3,353,708 A * 11/1967 Davis ..... 206/519
3,411,660 A 11/1968 LaFarge
3,572,413 A 3/1971 Livingstone
3,670,951 A 6/1972 Smith
3,721,365 A 3/1973 Saunders
3,741,431 A 6/1973 Burdick
3,753,512 A 8/1973 Curry
3,809,284 A 5/1974 Churan
3,863,796 A * 2/1975 Roy ..... 215/220
3,880,288 A * 4/1975 Hunter ..... 206/508
3,883,036 A 5/1975 Mahaffy
3,904,072 A 9/1975 Whiteside
3,995,766 A 12/1976 Fralick
4,006,837 A 2/1977 Gates
4,027,776 A 6/1977 Douglas
4,079,857 A * 3/1978 Crisci ..... 206/508
4,187,953 A 2/1980 Turner
4,201,311 A 5/1980 Underwood
4,380,305 A 4/1983 Von Holdt
4,399,926 A 8/1983 Eidels-Dubovoy
4,407,426 A * 10/1983 McLaren et al. ..... 220/781
4,418,832 A 12/1983 Schneider (Continued)

*Primary Examiner*—Anthony Stashick
*Assistant Examiner*—Christopher B McKinley
(74) *Attorney, Agent, or Firm*—Timothy A. Czaja; Douglas J. Taylor; Annette M. Frawley

(57) ABSTRACT

An overcap for selectively covering a container of a microwaveable packaged good article is described. The overcap includes a panel, a neck extending from the panel, and a skirt radially spaced from the neck. The skirt defines at least two areas of reduced thickness spaced from one another, which are configured to allow the skirt to flex when the overcap is removed from the container.

26 Claims, 14 Drawing Sheets

U.S. PATENT DOCUMENTS 4,421,244 A 12/1983 Van Melle
4,442,945 A * 4/1984 Sandhaus ..... 215/218
4,520,943 A 6/1985 Nielsen
4,535,905 A 8/1985 Sandhaus
4,625,890 A * 12/1986 Galer ..... 220/319
4,702,389 A * 10/1987 Bozinovich et al. ..... 220/784
4,705,172 A * 11/1987 Gage ..... 206/519
4,709,832 A 12/1987 Mantyla
4,723,676 A 2/1988 Kobayashi et al.
4,756,443 A 7/1988 Murayama
4,793,510 A 12/1988 Arfert
4,846,366 A 7/1989 Satz
4,886,184 A * 12/1989 Chamourian ..... 220/781
4,923,085 A 5/1990 Lillelund
4,961,510 A * 10/1990 Dvoracek ..... 220/713
D345,081 S * 3/1994 Adami et al. ..... D7/391
5,294,015 A * 3/1994 Landis ..... 220/784
5,381,918 A * 1/1995 Dahl ..... 220/784
5,390,810 A 2/1995 Stroble
5,411,160 A 5/1995 Goulet
5,411,161 A 5/1995 Fish, Jr.
5,452,818 A 9/1995 Yost
5,538,154 A 7/1996 Von Holdt
5,540,349 A * 7/1996 Philips ..... 220/780
5,582,317 A 12/1996 Wermund
5,603,422 A * 2/1997 Herrmann ..... 215/256
5,680,952 A 10/1997 Chasten
5,722,562 A * 3/1998 Kick ..... 220/785
5,725,123 A 3/1998 Otto-Nagels
5,860,543 A * 1/1999 Decelles ..... 215/209
5,860,545 A * 1/1999 Bartsch ..... 215/256
6,015,061 A 1/2000 Lowry
6,056,144 A 5/2000 Strange
6,056,145 A 5/2000 Rush
6,164,484 A 12/2000 Fiore
6,168,044 B1 1/2001 Zettle
6,220,471 B1 4/2001 Lowry
6,260,729 B1 7/2001 Mitchell
6,685,049 B1 * 2/2004 Paladino ..... 220/781
6,688,487 B2 2/2004 Oakes
6,729,491 B2 5/2004 Morris
6,779,676 B2 * 8/2004 Ciccone ..... 220/276
6,851,569 B2 2/2005 Conti
6,860,397 B1 3/2005 Walters, Jr.
7,112,771 B2 * 9/2006 Richardson et al. ..... 219/725
2002/0148846 A1 * 10/2002 Luburic ..... 220/792
2003/0015542 A1 1/2003 Nulty
2003/0085228 A1 5/2003 Oakes
2003/0222083 A1 * 12/2003 Pladsbjerg ..... 220/254.3
2003/0222084 A1 12/2003 Morris, Jr.
2004/0011803 A1 1/2004 D'Amato
2004/0094553 A1 5/2004 Crider
2004/0206765 A1 10/2004 McMahon, III
2004/0262309 A1 12/2004 Edwards
2005/0061815 A1 * 3/2005 Wong ..... 220/281
2005/0145627 A1 * 7/2005 Stull et al. ..... 220/254.3
2006/0032857 A1 * 2/2006 Stensbol et al. ..... 220/780

* cited by examiner

REMOVABLE OVERCAP FOR MICROWAVEABLE PACKAGED GOOD ARTICLE

CROSS-REFERENCE TO RELATED APPLICATIONS

This application is a continuation-in-part of U.S. application Ser. No. 11/261,110, filed on Oct. 28, 2005, and entitled "Microwaveable Packaged Good Article Overcap," which claims priority to and the benefit of Provisional Patent Application No. 60/622,892, filed on Oct. 28, 2004, and entitled "Microwaveable Packaged Good Article Overcap," the teachings of which are incorporated herein by reference in its entirety.

BACKGROUND

The present invention relates to a microwaveable packaged good article, and more particularly, it relates to an overcap for a microwaveable packaged good article.

Consumers have responded favorably to a variety of packaged foods provided as microwaveable packaged good articles. In particular, consumers have shown a strong preference for ready-to-eat packaged good articles that can be quickly and conveniently heated in a microwave oven. Some particularly popular packaged good articles include lunch or dinner entrees such as soups, chilies, stews, and pasta meals (e.g., spaghetti and ravioli) provided in sealed containers that are suitable for microwave heating.

In general, a microwaveable packaged good article includes a container containing a consumable item, an optional removable lid to sealingly preserve the consumable item within the container prior to preparation/consumption, and an overcap. To prepare the consumable item, the consumer typically first removes the overcap from the container for access to the removable lid. The removable lid is then separated from the container to expose the consumable item within the container. The overcap is then replaced on the container to form a covered cooking vessel. In this manner, the assembled container/overcap is readied for subsequent microwave heating of the consumable item.

During microwave heating, the consumable item is preferably heated to its boiling point. When the consumable item boils, steam is generated. In this regard, the overcap typically includes at least one vent to permit an equalization of pressure within the container. That is to say, the heated steam exits the container through the vent to alleviate a build-up of pressure inside the container. Boiling of the consumable item inevitably results in bubbling or splashing within the container, resulting in liquid accumulation along an inside surface of the overcap. Frequently, the bubbling/splashing consumable item will seep between the overcap and a lip of the container, dripping or flowing onto an exterior of the container.

For example, one known overcap for a microwaveable packaged good article includes a top panel provided with vent holes and a skirt descending from the top panel. A series of spaced reinforcing ribs is provided on the interior of the overcap, extending between an interior surface of the top panel and an interior side of the skirt. Upon final assembly, the ribs rest against a top of the container, with a portion of the skirt extending along an exterior of the container. Unfortunately, during microwave heating, the boiling consumable item within the container can accumulate between the reinforcing ribs and subsequently seep or drip between the skirt and the exterior of the container. These drips are unsightly, may soil the microwave (or other surface that the container is subsequently placed on), and may lead to user handling inconveniences.

In addition, the known overcap can deform when a large axial force is applied to the top panel. For example, during distribution and merchandising, several packaged good articles are commonly stacked vertically one on top of another. To this end, mass distribution normally entails grouping a number of individual packaged good articles within a tray or box, and then stacking multiple ones of the so-formed trays on a pallet. In this manner, a large axial loading is directed onto the top panel of the bottommost packaged good article present on a distributor's pallet or even a merchant's shelf.

By way of reference, the skirt/ribs of the known microwaveable container overcap are sized to position the top panel well above a top portion of the container to ensure adequate spacing during boiling. Thus, the overcap is supported relative to the container primarily by the ribs, which in turn are supported by the skirt. In the presence of axial loadings of greater than forty pounds, the known overcap exhibits structural failure in the form of the ribs deflecting or deforming, leading to non-reversible deformation of the skirt. These deformations create an unattractive merchandizing unit at the point of sale, reduce viability of the overcap during subsequent microwave heating and have the potential to damage the contained item by rupturing the removable lid. In any regard, the known overcap insufficiently resists deformation from axial loadings that are oftentimes encountered during normal distribution and merchandizing.

Consumers continue to show strong demand for microwaveable packaged good articles. Unfortunately, the standard overcap for microwaveable packaged good articles can lead to the boiling consumable item exiting the container and soiling the container's exterior and/or inside of the microwave. In addition, the known overcap employed with microwaveable packaged good articles can radially deform under common distribution and merchandizing loads, thus threatening the integrity of the packaged good article.

The typical radial deformation of known overcaps presents addition challenges in designing a microwaveable packaged good article. In particular, in order to maintain the overcap coupled to the container during microwave heating and radial deformation, the microwaveable packaged good article typically employs a rather robust coupling mechanism or means. However, the robust coupling mechanisms oftentimes require significant amounts of force applied in specific locations of the overcap to remove the overcap from the container. The amount of force required is even higher when the overcap has recovered from deformation or has not yet been heated to radially deform. The requirement of relatively high forces to remove the overcap decreases the ease of usability of the microwaveable packaged good article. In particular, individuals in general and especially individuals having relatively low strength or dexterity may have difficulties in removing the overcap from the container to access the consumable item contained therein. Attempts to address this problem have included addition of a release mechanism (e.g., pull tab) as part of the overcap design (e.g., formed during molding). Unfortunately, this approach entails significant additional costs and may not provide a consistent, easy-to-use product to the consumer.

Therefore, a need exists for an overcap for a microwaveable packaged good article that resists radial deformation and prevents boiling contents from exiting the container. A need also exists for an overcap that maintains overcap coupled to the container during use and expansion while still providing a container that is relatively easy to open when desired.

SUMMARY

Some aspects in accordance with the principles of the present invention relate to an overcap for selectively covering a container of a microwaveable packaged good article is described. The overcap includes a panel, a neck extending from the panel, and a skirt radially spaced from the neck. The skirt defines at least two areas of reduced thickness spaced from one another, which are configured to allow the skirt to flex when the overcap is removed from the container.

Other aspects of the present invention relate to a microwaveable packaged good article including a container and an overcap removably coupled to the container. The container includes a base and a continuous wall extending from the base and terminating in a chime. The overcap including a panel, a neck, and a skirt radially spaced from the neck. The skirt defines at least two areas of reduced thickness spaced from one another and being configured to allow the skirt to flex when the overcap is removed from the container.

Yet other aspects in accordance with the principles of the present invention relate to a method of microwave heating a packaged good article. The method includes providing a container, which defines a continuous wall terminating in a chime and contains a consumable item, and securing an overcap to the container. The overcap includes a panel, a neck extending from the panel, and a skirt radially spaced from the neck and defining at least two areas of reduced thickness spaced from one another. The at least two areas of reduced thickness are configured to allow the skirt to flex when the overcap is removed from the container. The method further includes microwave heating the packaged good article to boil the consumable item and to radially expand the overcap, and removing the overcap from the container including flexing the overcap at the at least two areas of reduced thickness.

BRIEF DESCRIPTION OF THE DRAWINGS

Embodiments of the invention are better understood with reference to the following drawings. The elements of the drawings are not necessarily to scale relative to each other. Like referenced numerals designate corresponding similar parts.

DETAILED DESCRIPTION

Figure 1:
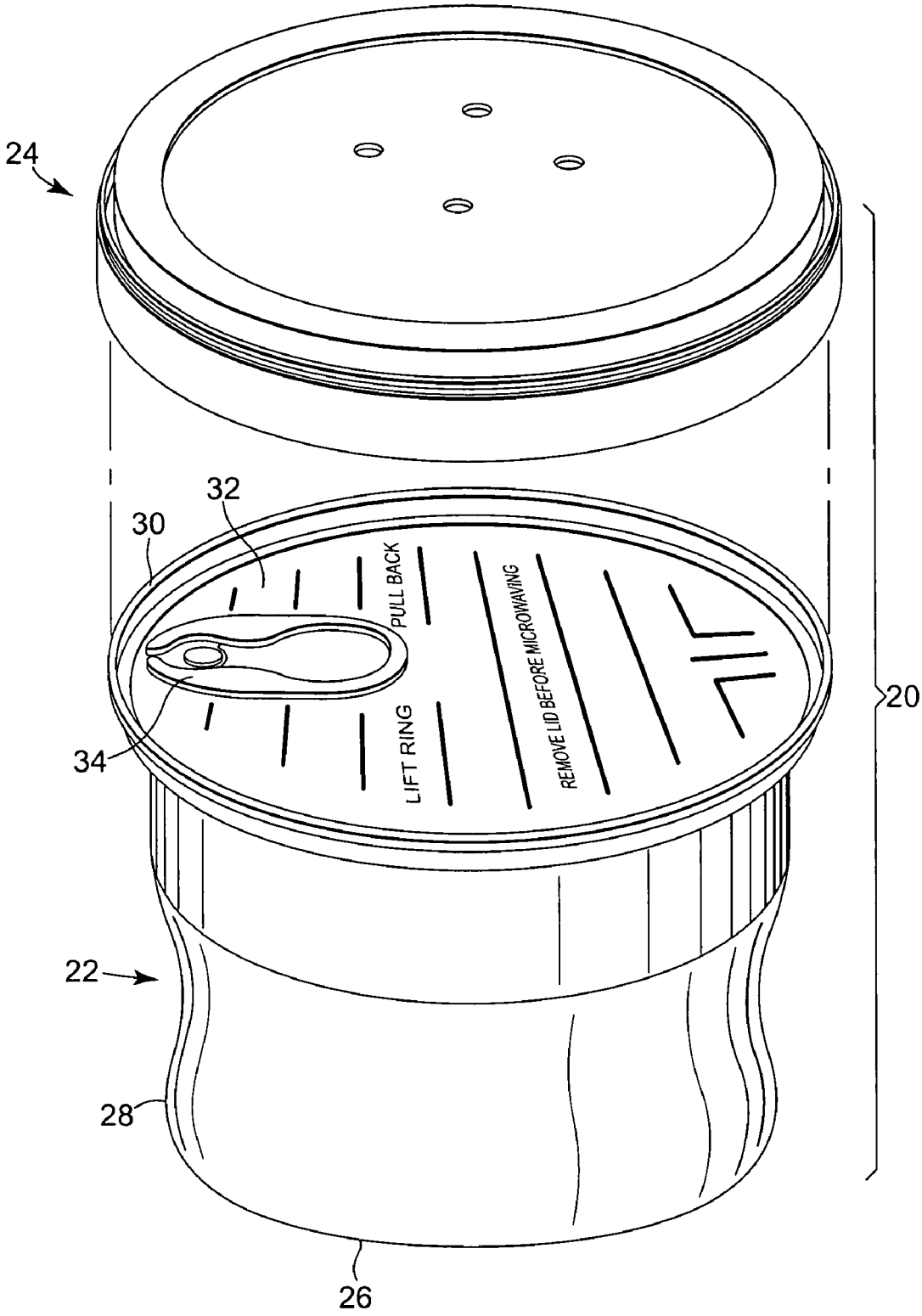
FIG. 1 is a perspective view of a microwaveable packaged good article showing a container including an optional removable lid and a displaced overcap according to aspects of the present invention.

An exemplary microwaveable packaged good article 20 according to principles of the present invention is illustrated in perspective view in FIG. 1. The microwaveable packaged good article 20 includes a container 22 and an overcap 24. As described more fully below, the overcap 24 is configured to couple to the container 22 to permit distribution and merchandizing, and eventual microwave heating, of the packaged good article 20.

The container 22 includes a base 26 (referenced generally in FIG. 1) and a continuous wall 28 extending from the base 26 and terminating in a chime 30. The base 26 and wall 28 are integrally formed from a relatively rigid, microwaveable-material, such as molded plastic. The wall 28 can assume a wide variety of shapes differing from the one exemplary embodiment depicted in the Figures. The chime 30 is, in one embodiment, formed apart from the base 26/wall 28, and is of a highly rigid nature, such as metal (e.g., rolled aluminum). The size and shape of the chime 30 can differ from the one embodiment depicted in the Figures, as is known in the art.

In one embodiment, a removable lid 32 is removably attached to the chime 30 and includes a pull tab 34 to facilitate detaching the removable lid 32 from the chime 30. However, it should be understood that other mechanisms and methods for removing the removable lid 32 from the chime 30 are equally acceptable. The chime 30/lid 32 construction is, in one embodiment, in accordance with conventional designs in which the chime 30/lid 32 is simultaneously formed from metal and provided with a score-line (or partial cut) to facilitate separation of the lid 32 from the chime 30 by a user. Alternately, the lid 32 can be eliminated. As a point of reference, when the container 22 has the lid 32 attached, the container 22 and the lid 32 combine as shown to form a full panel, easy-open container.

Figure 2:
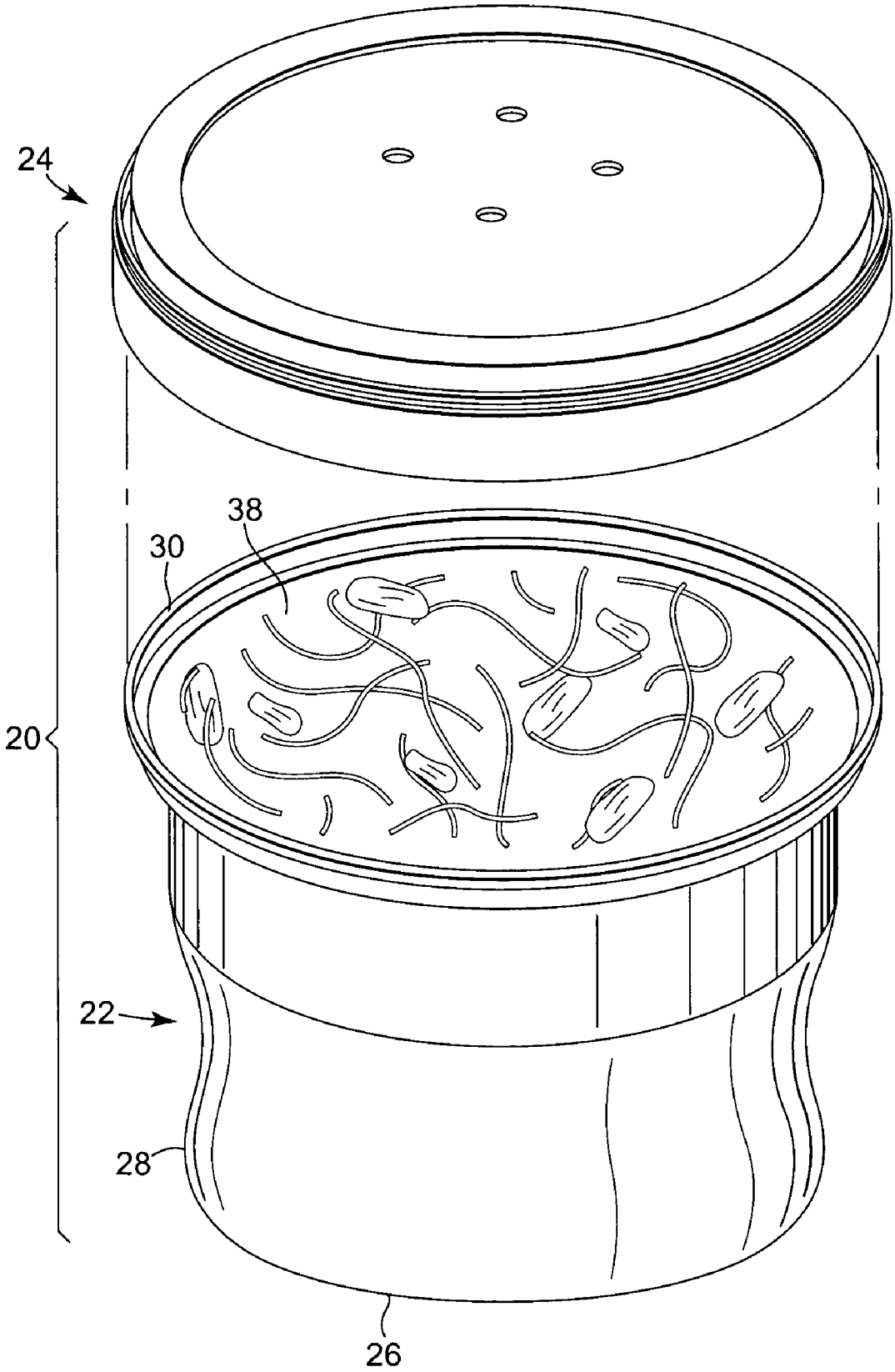
FIG. 2 is a perspective view of the microwaveable packaged good article of FIG. 1 showing the removable lid removed from the container.

FIG. 2 illustrates the microwaveable packaged good article 20 including a consumable item 38 within the container 22 and the overcap 24 poised for attachment to the container 22 prior to microwave heating (or following disassembly of the overcap 24 after microwave heating). In general, the consumable item 38 will have a sufficient amount of moisture to facilitate microwave heating. However, it is also recognized that consumers will occasionally add liquid (e.g., water) to the consumable item 38 as a preference, or in following cooking instructions. Examples of acceptable consumable items 38 useful with the packaged good article 20 of the present invention include soup (dry or liquid) having various ingredients such as pasta, beans, meat, and/or vegetables; chili; stew; pasta meals (e.g., spaghetti, ravioli, etc.); pork-and-beans; etc., to name but a few. In any regard, the consumable item 38 can fill the container 22 up to the level of the chime 30 (although the level is typically below the chime 30 to avoid accidental spilling when handling the container 22), and can be microwave heated to the point of boiling.

Figure 3A:
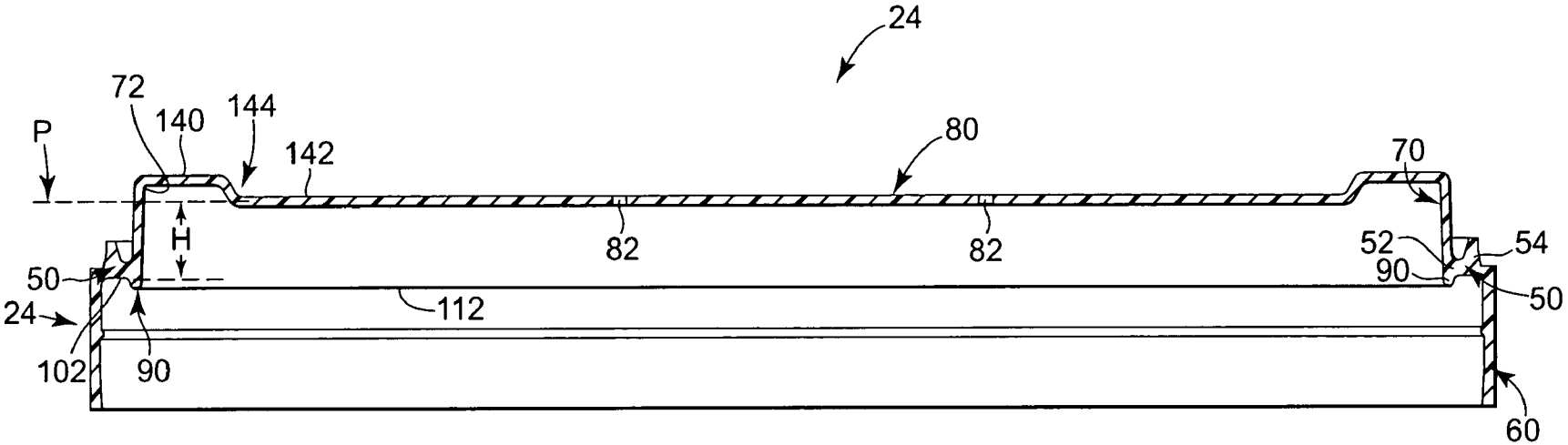
FIG. 3A is a cross-sectional view of the overcap shown in FIG. 2.

One embodiment of the overcap 24 is shown in greater detail in FIG. 3A. The overcap 24 includes or integrally forms a shoulder 50, a skirt 60, a neck 70, a panel 80, and a drip bead 90. Details on the various components are provided below. In general terms, however, the neck 70 extends from the panel 80, terminating in the drip bead 90 longitudinally opposite the shoulder 50. The skirt 60, in turn, extends from the shoulder 50. In this regard, the skirt 60 is radially spaced from the drip bead 90 by the shoulder 50. More particularly, in one embodiment the shoulder 50 includes a transition segment 52 and a rib structure 54. Relative to the upright orientation of FIG. 3A, the skirt 60 descends from the rib structure 54. Conversely, a first portion of the neck 70 ascends from the transition segment 52 and generally defines a top portion 72 that is connected to (or integrally formed with) the panel 80. In addition, a second portion of the neck 70 descends from the transition segment 52 to form the drip bead 90. It will be understood that the drip bead 90 can be described as being a component separate from the neck 70 (e.g., formed as part of the shoulder 50), or as an integral part of the neck 70. Regardless, in one embodiment, the drip bead 90 is radially offset from the skirt 60 to facilitate coupling of the overcap 24 about the chime 30 (FIG. 2), as more fully described below. As employed throughout this Specification, directional terminology such as "ascends," "descends," "top," "bottom," "front," "back," "leading," "trailing," etc., is used for purposes of illustration only and is in no way limiting. Further, while various features of the overcap 24 are described in the context of being identifiable, separate components, in some embodiments, the overcap 24 is an integral, homogenous body (e.g., molded part) such that the components can be viewed as being continuous structure(s).

The shoulder 50 can assume a variety of configurations that may or may not include one or both of the transition segments 52 and/or the rib structure 54, and/or additional structure(s). Regardless, and with specific reference to FIG. 3B, the shoulder 50 defines an interior surface 100 (referenced generally) and an exterior surface 102 (referenced generally). For example, the transition segment 52 and the rib structure 54 combine to define the interior and exterior surfaces 100, 102. With these conventions in mind, the skirt 60, the drip bead 90, and the interior surface 100 of the shoulder 50 combine to form a channel 110. In one embodiment, the channel 110 is a continuous annular channel circumscribing an outer periphery of the drip bead 90. Alternatively, the channel 110 can have a more intermittent configuration. With any of these embodiments, however, the channel 110 is sized and configured to nest about the chime 30 (FIG. 2) in forming a barrier to the passage of liquids between the overcap 24/container 22 (FIG. 2) interface.

In addition to defining a portion of the channel 110, in some embodiments the shoulder 50 is configured to enhance an overall rigidity of the overcap 24 (as compared to conventional microwaveable packaging overcaps) when assembled to the container 22 (FIG. 1). To this end, the transition segment 52 supports the neck 70 upon final assembly (with the skirt 60 is otherwise nested against the container 22), serving to limit deformation of the neck 70 in response to an axial-type force placed upon the panel 80. With this in mind, in one embodiment, the transition segment 52 has a nominal thickness of at least 0.035 inch, more preferably approximately 0.04 inch (±0.005 inch). In other embodiments described below, a thickness of the shoulder 50 at the point of intersection with the neck 70 is further increased. Thus, in some embodiments, the shoulder 50 has an increased, cross-sectional thickness as compared to known microwaveable overcap designs so as to provide structural rigidity to the overcap 24. More particularly, the shoulder 50 enables the overcap 24 to resist deformation as the microwaveable packaged good article 20 (FIG. 1) is distributed and merchandized.

The rib structure 54 provides surface adapted to facilitate stacking of one overcap 24 over another. In particular, the rib structure 54 defines a guide surface 120 that, combined with a ledge 122 defined by the skirt 60, forms a stacking feature. The stacking feature is configured such that a first overcap 24 can be stacked over and onto a second overcap 24 (such as within a magazine of an assembly apparatus) by sliding the skirt 60 of the first overcap 24 over and along the guide surface 120 and into nested contact with the ledge 122 of the second overcap 24. To this end, extension of the guide surface 120 from the ledge 122 forms a stacking angle S. It has surprisingly been found that by forming the stacking angle S to be greater than 90 degrees, ease of stacking one overcap 24 to a second overcap 24 is enhanced. In one embodiment, the stacking angle S is in the range of 90-110 degrees, more preferably approximately 100 degrees, although other angles are also acceptable. Further, in one embodiment, a height of the rib structure 54 relative to the ledge 122 is in the range of 0.04-0.10 inch, preferably 0.065-0.085 inch, more preferably approximately 0.0745 inch (although other dimensions are also acceptable). It has surprisingly been found that this one preferred height combined with the one preferred stacking angle S (described above) optimally facilitates overcap 24 stacking. Alternatively, the rib structure 54 can assume other configurations.

In addition to the ledge 122, in one embodiment, the skirt 60 forms one or more clip(s) 62 as projections from an interior skirt surface 64. The clip(s) 62 is configured to facilitate snap-fit of the overcap 24 over the chime 30 (FIG. 2) in removably securing the overcap 24 to the container 22 (FIG. 2). With this in mind, in one embodiment the clip 62 is a continuous annular band formed about an entire circumference of the interior skirt surface 64. In another embodiment, the clip 62 is formed by a plurality of discrete segments extending from the interior skirt surface 64 and forms an interrupted clip 62. In one embodiment, the interrupted clip 62 includes approximately ten discrete segments projecting from the interior skirt surface 64. Regardless, the clip(s) 62 can assume a variety of forms, and in one embodiment is defined by opposing first and second surfaces 66*a*, 66*b* that combine to define an included angle in the range of 80-100 degrees, preferably 90 degrees. Regardless, the skirt 60 is characterized by a reduced thickness immediately adjacent the second surface 66*b* (as compared to a thickness of the skirt 60 immediately adjacent the first surface 66*a*), increasing in thickness to a trailing end 68. This one configuration promotes user disassembly of the overcap 24 from the container 22 (via grasping of the skirt 60) as the skirt 60 will more readily flex in the region of decreased thickness.

As previously described, the neck 70 is formed opposite the skirt 60 and forms (or extends to) the drip bead 90. The drip bead 90 descends relative to the interior surface 100 of the shoulder 50 by a distance D. The distance D is defined as the distance between a leading end 112 of the drip bead 90 and the interior surface 100 of the shoulder 50. With this convention in mind, the drip bead 90 is offset from the skirt 60, and thus defines a height (i.e., the distance D) of the channel 110. To this end, in one embodiment the distance D is greater than 0.01 inch, preferably the distance D is greater than 0.02 inch, and more preferably the distance D is greater than 0.023 inch. For example, in one exemplary embodiment, the distance D that the drip bead 90 descends relative to the interior surface 100 of the shoulder 50 is approximately 0.0257 inch. As will be made clearer below, the distance D equates to an effective length the drip bead 90 extends within the container 22 (FIG. 2) when the overcap 24 is assembled to the chime 30 (FIG. 2). Thus, in alternative embodiments, the length of the drip bead 90 (i.e., the distance D) can be greatly increased (i.e., greater than 0.03 inch), limited only by a lateral position of the removable lid 32 (FIG. 1) or other internal container element that the drip bead 90 might otherwise contact upon assembly of the overcap 24 to the container 22. In fact, the drip bead 90 can alternatively be sized and/or shaped (e.g., varying from the shape of FIG. 3B) so as to extend to and contact a surface of the container 22 (for example, the removable lid 32 (FIG. 2)) in a manner that provides vertical support to the drip bead 90 and thus the neck 70. Regardless, the neck 70 and the drip bead 90 are preferably continuous about an entirety of the overcap 24 (e.g., formed as an annular ring) to provide a complete closure surface.

In addition to the drip bead 90, the neck 70 forms a nesting feature in one embodiment. In particular, the neck 70 defines an exterior surface 132 that extends from the shoulder 50/transition segment 52 at a nesting angle N (relative to the ledge 122 or a horizontal plane of the overcap 24 when the overcap 24 is in the upright orientation of FIG. 3B). The nesting angle N is selected to permit separation of overcaps 24, for example as one overcap 24 is removed from a magazine of stacked overcaps 24, as described above. In one embodiment, the nesting angle N is preferably only slightly greater than 90 degrees (e.g., in the range of 91-95 degrees), and more preferably, the nesting angle N is approximately 93 degrees. This slight off-set from a true 90-degree relationship (relative to horizontal) has been surprisingly found to not only facilitate desired unstacking of overcaps 24, but also enhances overall stability of the overcap 24 when assembled to the container 22 (FIG. 2). To this end, the nesting angle N represents an angular extension of the neck 70 relative to the shoulder 50, with the shoulder 50 providing primary support for the neck 70 when assembled to the chime 30 (FIG. 2) as described below. With this in mind, it has been surprisingly found that by forming the nesting angle N to approximate 90 degrees, optimum support of the neck 70 is achieved. This is in contrast to conventional overcap configurations in which the nesting angle of the neck 70 is normally on the order of 100 degrees.

Finally, and as best shown in FIG. 3A, the panel 80 is connected to or extends from the top portion 72 of the neck 70. In this manner, an overcap headspace H formed, defined as a distance between the interior surface 100 of the transition segment 52 (and thus the "top" of the channel 110) and the panel 80. With this in mind, when the overcap 24 is coupled to the container 22 (FIG. 2), the headspace H therefore also represents the distance between the chime 30 (FIG. 2) and a majority of the panel 80. The headspace H provides an expansion space for steam created when moisture in the consumable item 38 (FIG. 2) is heated, as well as a boundary region to contain boiling of the consumable item 38. To facilitate release of steam generated during microwave heating of the packaged good article 10 (FIG. 1), the panel 80 includes one or more vents 82. While four vents 82 are illustrated (as best shown in FIG. 1), it should be understood that any number of vents 82 can be formed in the panel 80 to facilitate the venting of the steam formed when heating the consumable item 38.

In one embodiment, the panel 80 includes an annular flange 140 and a central portion 142 connected to the annular flange 140. The annular flange 140 and the central portion 142 combine to form a stacking recess 144. The stacking recess 144 is configured to accept the base 26 (FIG. 1) of one of a vertically stacked packaged good article 20 (FIG. 1). In this regard, the central portion 142 is disposed in a plane P, where the plane P is offset from the annular flange 140 such that the stacking recess 144 provides resistance to a lateral movement of vertically stacked packaged good articles 20. Alternatively, the panel 80 can assume a variety of other configurations.

The overcap 24 can be constructed of any microwave-compatible material that is sufficiently stiff to thus resist buckling when one or more other packaged good articles 20 (FIG. 1) are stacked on top of the overcap 24, and flexible enough to permit the skirt 60 to be levered away from the chime 30 (FIG. 2) in removing the overcap 24 from the container 22. Exemplary materials for the overcap 24 include, but are not limited to, polymers in general, including polyolefins such as polypropylene and polyethylene, polyesters, polyamides including nylon, filled polymers, poly-coated paper, and paperboard. The overcap 24 can be formed in a variety of fashions, and in one embodiment, is an integrally molded body. Alternatively, various component(s) described above can be separately formed and subsequently assembled.

Figure 3B:
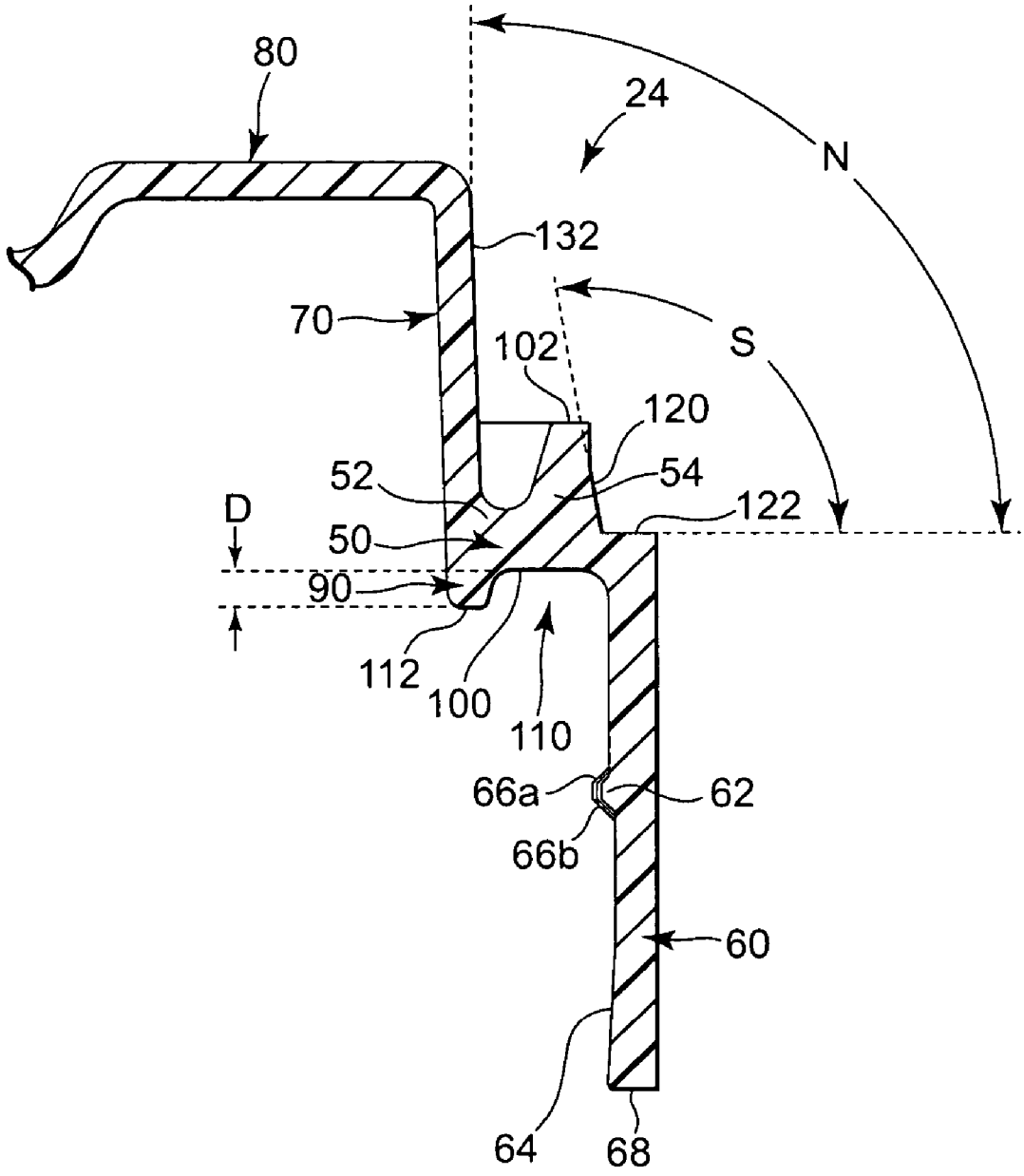
FIG. 3B is an enlarged view of a portion of FIG. 3A.
Figure 4:
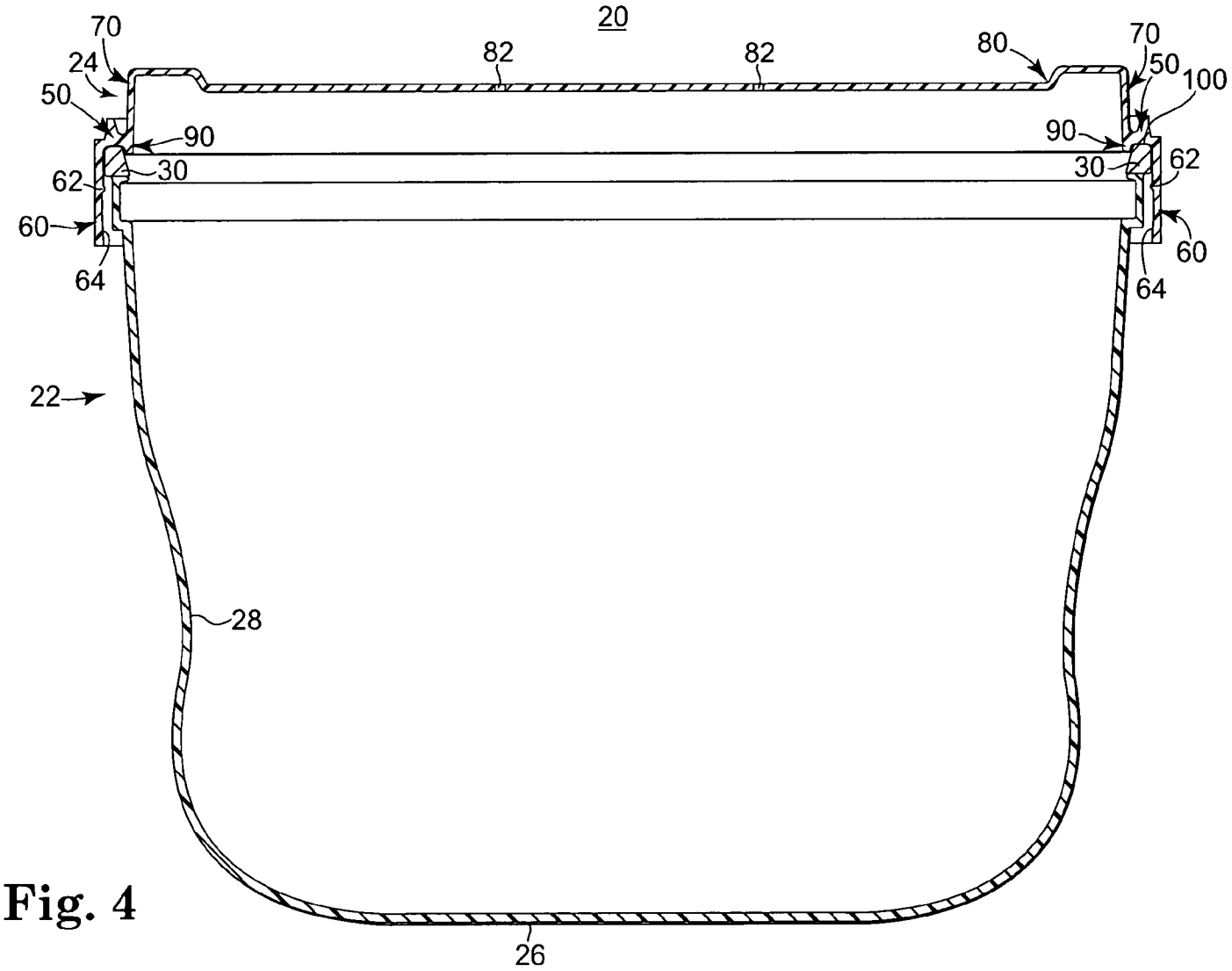
FIG. 4 is a cross-sectional view of the overcap of FIG. 3A assembled to the container.

FIG. 4 illustrates a central cross-section of the overcap 24 coupled to the container 22. Once again, the container wall 28 terminates in the chime 30 that may or may not be connected to the removable lid 32 (FIG. 1). The overcap 24 is removably coupled to the container 22 about the chime 30 such that the drip bead 90 projects into the container 22. More particularly, the chime 30 is received within the channel 110 (FIG. 3B) defined by the overcap 24. The skirt 60 extends along an exterior of the container 22, with the clip(s) 62 nesting against a bottom of the chime 30. In this position, the interior surface 100 of the shoulder 50 bears against the chime 30. The drip bead 90 and a portion of the interior surface 64 of the skirt 60 may also contact the chime 30. In a preferred embodiment, the channel 110 is a continuous annular channel, with the drip bead 90 projecting over the chime 30 in forming a guide surface from an interior of the overcap 24 to an interior of the container 22 and a barrier to the passage of liquids between the overcap 24/container 22 interface.

In particular, during microwave heating (i.e., with the lid 32 (FIG. 1) removed and the overcap 24 assembled to the container 22), an established consumer preference is to at times heat the consumable item 38 (FIG. 2) until boiling is achieved. During heating of the consumable item 38, moisture in the form of steam expands in the container 22 and naturally increases the pressure inside the container 22/overcap 24 assembly. To this end, the headspace H is provided to permit the steam/consumable item 38 to expand slightly, while the vents 82 permit the steam to escape through the overcap 24. In this way, an equalization of pressure between the container 22/overcap 24 and the atmosphere is achieved.

When boiling is achieved, the consumable item 38 (FIG. 2) will bubble and expand into a portion of the headspace H (FIG. 3A). In so doing, the consumable item 38 will splatter and/or condense across an interior of the overcap 24 (e.g., at or along the panel 80 and/or the neck 70). The annular drip bead 90 directs dripping (e.g., induced by gravity) of at least a portion of this accumulated consumable item 38 from the panel 80 and/or the neck 70 back into the container 22. Specifically, the drip bead 90 projects below a topmost portion of the chime 30 by the distance D (FIG. 3) such that the consumable item 38 accumulated along an interior of the overcap 24 (especially at or near the neck 70), as it falls under the action of gravity, is directed along the drip bead 90 and returned to the container 22 (it being understood that spattered and/or condensed consumable item 38 at a central portion of the panel 80 may not necessarily flow or progress to the neck 70, but instead will remain on the panel 80 and/or simply drip directly back into the container 22 via gravity). In this manner, the boiling consumable item 38 is consistently contained within the container 22/overcap 24 such that seeping or dripping of the consumable item 38 to an exterior of the container 22 is minimized and/or eliminated. Thus, the mess and potential handling inconveniences associated with conventional microwaveable packaging is eliminated.

Figure 5:
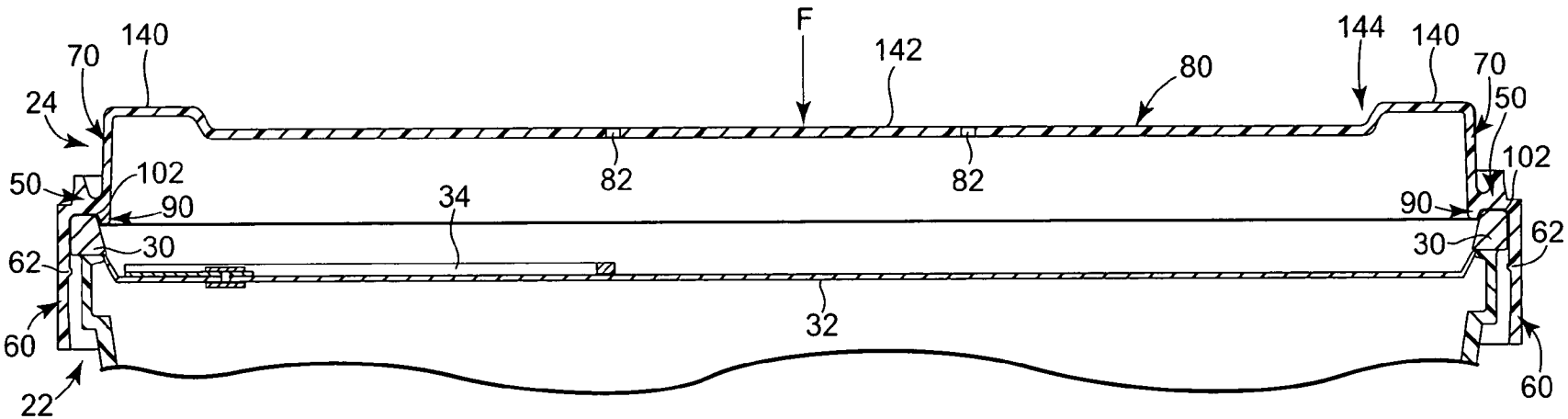
FIG. 5 is a cross-sectional view illustrating axial forces applied to the overcap and container of FIG. 4.

Another aspect of the overcap 24 relates to enhanced structural integrity during normal shipping activities as best described with reference to FIGS. 1 and 5. During distribution, several packaged good articles 20 are typically packaged into a carton or tray, and multiple trays will be stacked onto a pallet. In this regard, the bottommost packaged good articles 20 will bear the weight of the trays/packaged good articles (not shown) above them, represented by force F being applied to the panel 80 (with the force F increasing with a greater number of stacked articles 20/trays). Where each tray consists of a single "layer" of packaged good articles 20, the force F placed on the top panel 80 by a tray(s) on top of the tray in which the packaged good article 20 resides will be focused on the annular flange 140. Conversely, where one packaged good article (not shown) is stacked on a second article 20, the base (not shown) of the upper container (not shown) contacts the central portion 142 of the overcap 24 of the bottom article 20 and is maintained within the stacking recess 144. Thus, under these circumstances, the force F will be focused upon the central portion 142. Regardless, the loading incident upon the overcap 24 of any one individual packaged good article 20 can be significant. In application, for example during distribution, where multiple trays of packaged good articles 20 are stacked vertically, the loading force F onto an individual overcap 24 at the bottom of the stacked packaged good articles 20 can exceed 50 pounds.

With the above in mind, the overcap 24 is capable of withstanding relatively large loading forces F and can resist deformation that would otherwise damage the known, prior overcaps. In particular, when the overcap 24 is assembled to the container 22, the chime 30 is received within the channel 110 (FIG. 3B). To this end, the shoulder 50 and drip bead 90 each contact the chime 30. Thus, the chime 30 supports the neck 70 (via contact with the drip bead 90 and the shoulder 50), and the neck 70 in turn supports the force F applied to the panel 80. The neck 70 is thus a most likely failure point for at least two reasons. First, if the neck 70 were to overtly laterally expand or deflect in response to the force F, the shoulder 50 may lose contact with the chime 30, causing the entire overcap 24 to slide downwardly onto the container 22. Second, the neck 70 may buckle in response to the force F. The overcap 24 of the present invention is uniquely configured to overcome these concerns.

First, when the chime 30 is nested within the channel 110 (FIG. 3), the drip bead 90 bears against an interior surface of the chime 30. This relationship resists lateral or radially outward deflection of the neck 70 relative to the chime 30. In particular, the drip bead 90 effectively locks against the chime 30 in response to a lateral component of the force F being translated through the neck 70. Along these same lines, the neck 70, in one embodiment, is oriented at an approximately 90-degree angle (i.e., the nesting angle N of FIG. 3B) relative to the shoulder (e.g., 91-95 degrees) and at an approximately 90-degree angle relative to the panel 80 (e.g., 91-95 degrees). This relationship dictates that the force F is translated through the neck 70 in a substantially perpendicular manner relative to the shoulder 50/chime 30 interface, thereby minimizing a lateral or radially outward component of the force F across the neck 70.

In addition, in one embodiment, the shoulder 50 is relatively thick in cross-section (especially as compared to prior art microwaveable overcaps) as previously described. This increased thickness enhances a stiffness of the neck 70, thus supporting the neck 70 against possible buckling in response to the force F.

It has been surprisingly discovered that the overcap 24 of the present invention coupled to the container 22 can maintain its structural integrity in the presence of an axial force F in excess of approximately 50 pounds. It has been found that known prior art overcaps exhibit irreversible damage under similar conditions. Notably, the enhanced integrity of the overcap 24 is achieved while minimizing a thickness of the neck 70 (and thus optimizing material costs) for example, on the order of 0.020-0.030 inch. The neck 70 can have other shapes that further heighten a stiffness of the neck 70.

Figure 6:
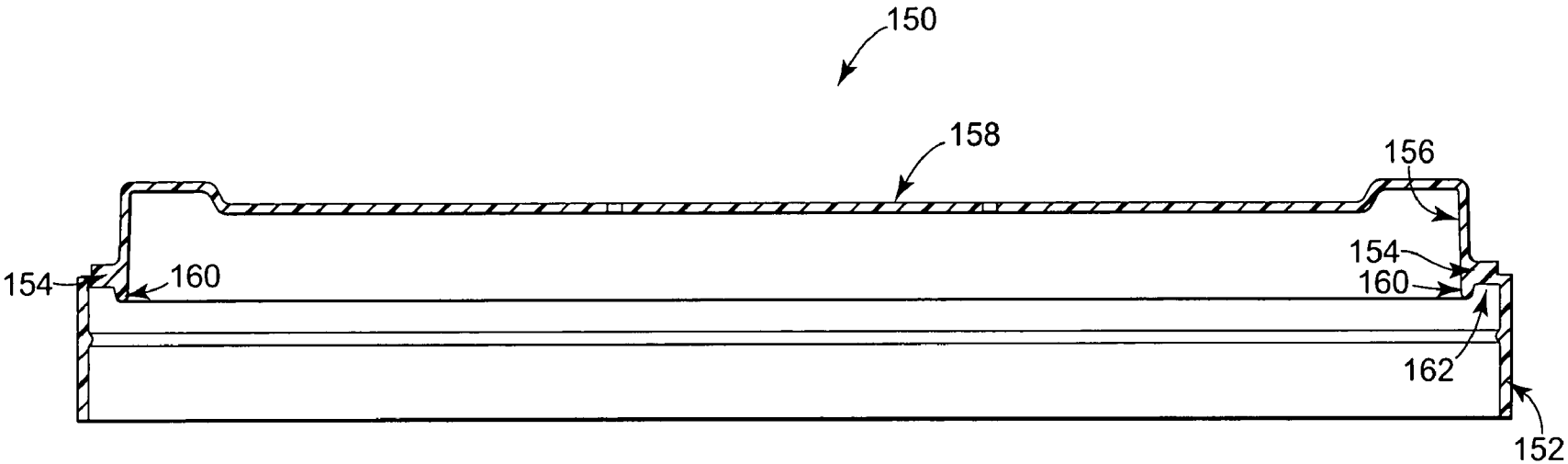
FIG. 6 is a cross-sectional view of another embodiment overcap in accordance with principles of the present invention.

Further, in other alternative embodiments, a thickness of the shoulder 50/transition segment 52 can be further increased (as compared to disclosed embodiments) to enhance overall rigidity. For example, FIG. 6 illustrates an alternative embodiment overcap 150. The overcap 150 is similar to the overcap 24 (FIG. 3A) previously described, and includes a skirt 152, a shoulder 154, a neck 156, and a panel 158. The neck 156 and/or shoulder 154 forms a downwardly projecting drip bead 160 as part of a channel 162. As compared with the overcap 24 previously described, the overcap 150 of FIG. 6 forms the shoulder 154 to have a relatively uniform thickness, on the order of at least 0.05 inch, more preferably approximately 0.07 inch. This elevated thickness provides increased structural rigidity/support to the neck 156 for the reasons described above.

Figure 7:
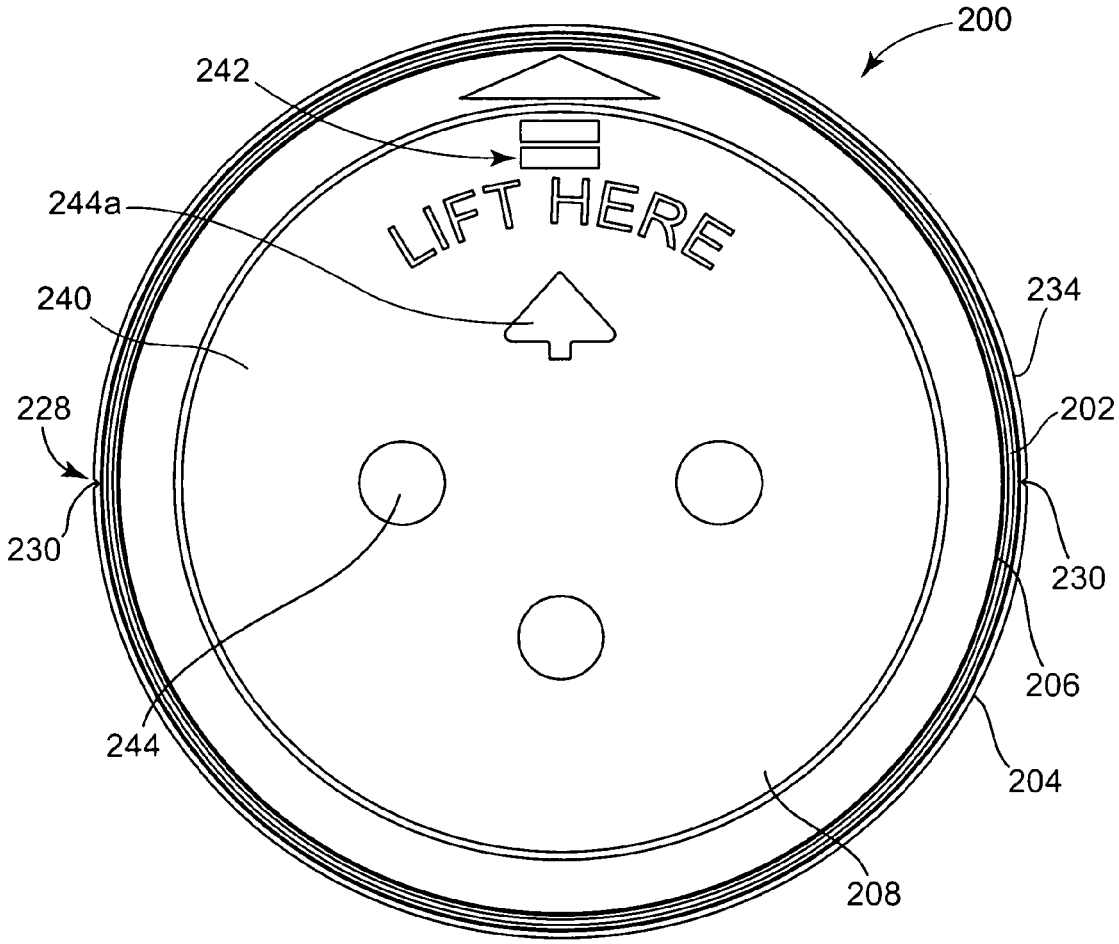
FIG. 7 is a top view of one embodiment of an overcap for use with the container of FIG. 1.
Figure 8:
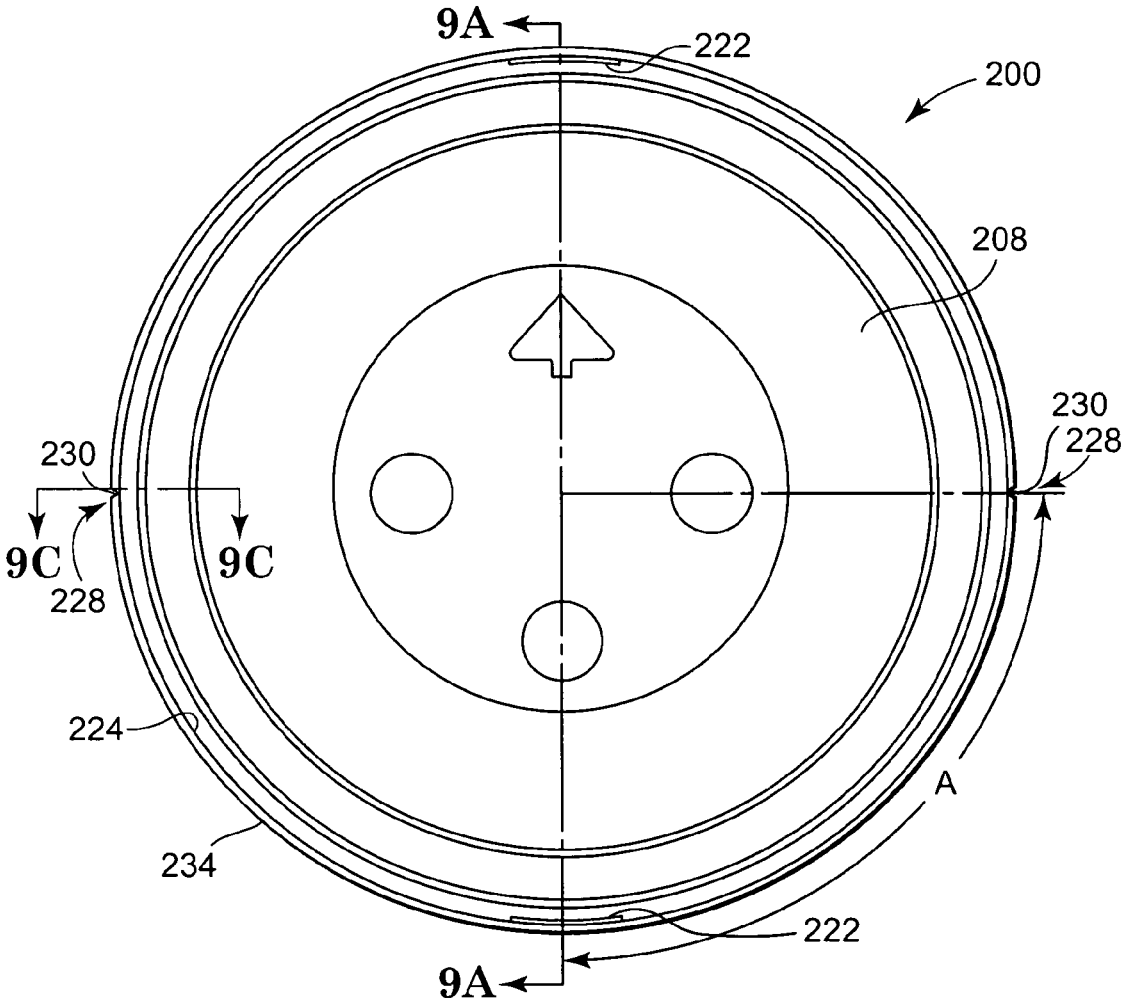
FIG. 8 is a bottom view of the overcap of FIG. 7.

FIGS. 7-8 illustrate a top and bottom view, respectively, of one embodiment of an overcap 200 configured to be coupled to the container 22 (FIG. 1) to permit distribution and merchandising and eventual microwave heating of a resultant packaged good article. The overcap 200 is substantially similar to the previously described overcap 24 (FIG. 1) except where otherwise enumerated below. In one embodiment, the overcap 200 includes or integrally forms a shoulder 202, a skirt 204, a neck 206, a panel 208, and a drip bead 210 (FIGS. 9A-9B), which are generally similar to the shoulder 50, the skirt 60, the neck 70, the panel 80, and the drip bead 90 of the overcap 24 described above with respect to FIGS. 1-6.

In general terms, the panel 208 is substantially circular. As illustrated with additional reference to FIGS. 9A-9C, in one embodiment, the neck 206 extends from a perimeter of the panel 208 terminating in the drip bead 210 longitudinally opposite the shoulder 202. The shoulder 202 extends radially outward from the neck 206, and the skirt 204, in turn, extends from the shoulder 202. In this regard, the skirt 204 is radially spaced from the drip bead 210 by the shoulder 202. Relative to the upright orientation of FIG. 9A, the skirt 204 descends from the shoulder 202 opposite the neck 206.

In addition, a portion of the neck 206 descends from the shoulder 202 to form the drip bead 210. It will be understood that the drip bead 210 can be described as being a component separate from the neck 206 (e.g., formed as part of a shoulder 202), or as an integral part of the neck 206). Regardless, in one embodiment, the drip bead 210 is radially offset from the skirt 204 to facilitate coupling of the overcap 200 about the chime 30 of the container 22 (FIG. 2), as more fully described below. Further, while various features of the overcap 200 are described in the context of being identifiable, separate components, in some embodiments, the overcap 200 is an integral, homogenous body (e.g., molded part) such that the components can be viewed as each being part of a continuous structure.

Keeping in mind the conventions described above, the skirt 204, the drip bead 210, and an interior surface 218 of the shoulder 202 combine to form an interior channel 220 (FIG. 9B) therebetween. In one embodiment, the channel 220 is a continuous, annular channel circumscribing an outer periphery of the drip bead 210. Alternatively, the channel 220 can have a more intermittent configuration. With any of these embodiments, however, the channel 220 is sized and configured to nest about the chime 30 (FIG. 2) to form a barrier to the passage of liquids through the interface between the overcap 200 and the container 22 (FIG. 2).

In one embodiment, the skirt 204 defines one or more clip(s) 222 projecting from an interior skirt surface 224. The clip(s) 222 is configured to facilitate snap/fit of the overcap 200 over the chime 30 (FIG. 2) to removably secure the overcap 200 to the container 22 (FIG. 2). With this in mind, each clip 222 is spaced from the shoulder 202 a distance dependent on the distance the chime 30 extends from a top of the container 22, more particularly, a distance sufficient to selectively maintain the chime 30 between the shoulder 202 and the clip 222. In one embodiment, each clip 222 is a discrete segment extending from the interior skirt surface 224 and is circumferentially spaced about the skirt 204 from the other clips 222, if any. The number of clips 222 is configured to provide sufficient resistance to prevent the inadvertent removal of the overcap 200 from the container 22 while still allowing the overcap 200 to be relatively easily removed from the container 22 when desired. In one embodiment, at least two and less than four clips 222 are included in the overcap 200. In one example, as illustrated with reference to FIGS. 8 and 9A, two clips 222 are formed at the interior skirt surface 224 and are diametrically opposed to one another.

Figure 9A:
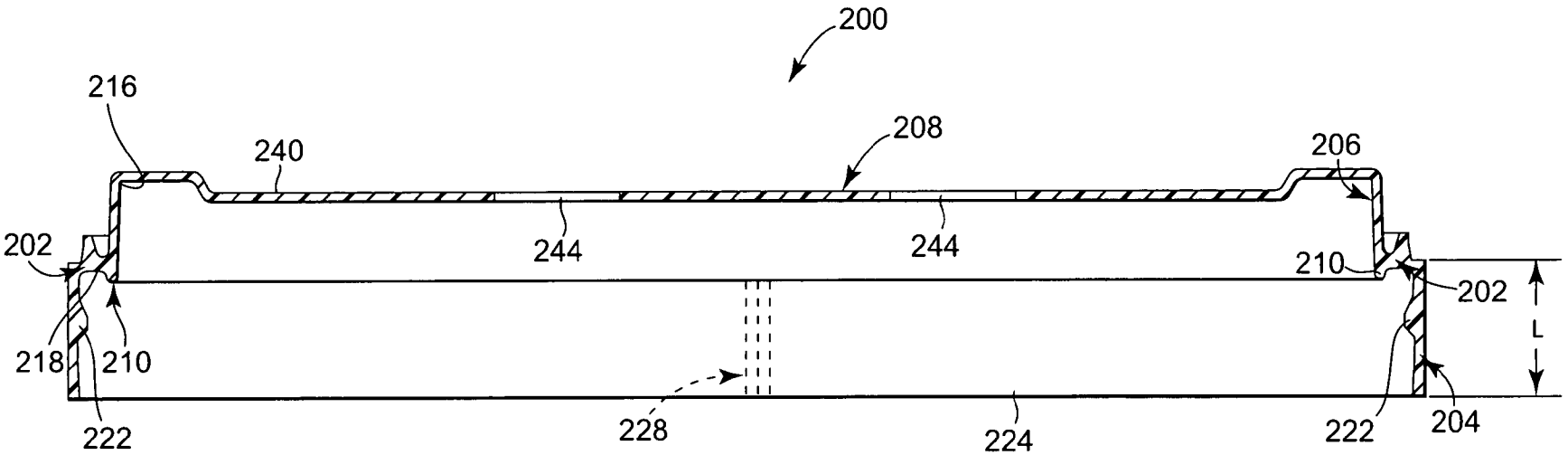
FIG. 9A is a cross-sectional view of the overcap shown in FIG. 8 taken along the line 9A-9A.
Figure 9B:
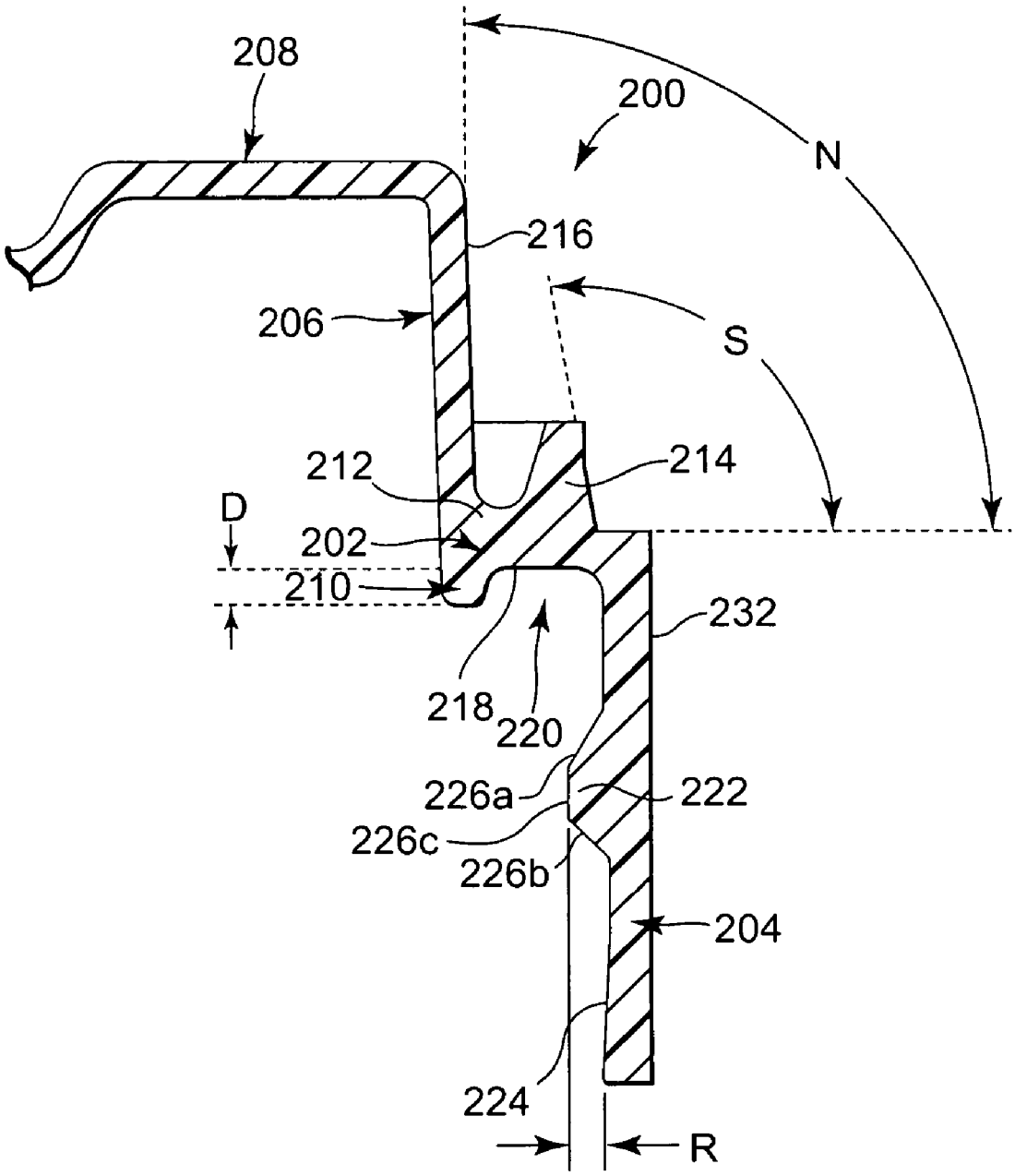
FIG. 9B is an enlarged view of a portion of FIG. 9A.

Each clip 222 can assume a variety of forms, and in one embodiment, as illustrated in FIG. 9B, are defined with a frustro-triangular cross-sectional shape including opposing first and second clip surfaces 226*a*, 226*b*. In one example, the first clip surface 226*a* extends from the interior skirt surface 224 to define an angle between the first clip surface 226*a* and a horizontal, which is defined when the overcap 200 is in the orientation illustrated in FIG. 9B, in the range of about 30° to about 75°. A third clip surface 226*c* is defined by the clip 222 opposite the interior skirt surface 224 and extends between the first and second clip surfaces 226*a*, 226*b*. In one embodiment, each clip 222 extends from the interior skirt surface 224 inward a radial distance R. The distance R is preferably sufficient to maintain the chime 30 (FIG. 2) within the channel 220 during storage and even after expansion of the overcap 200 due to microwave heating.

Figure 10:
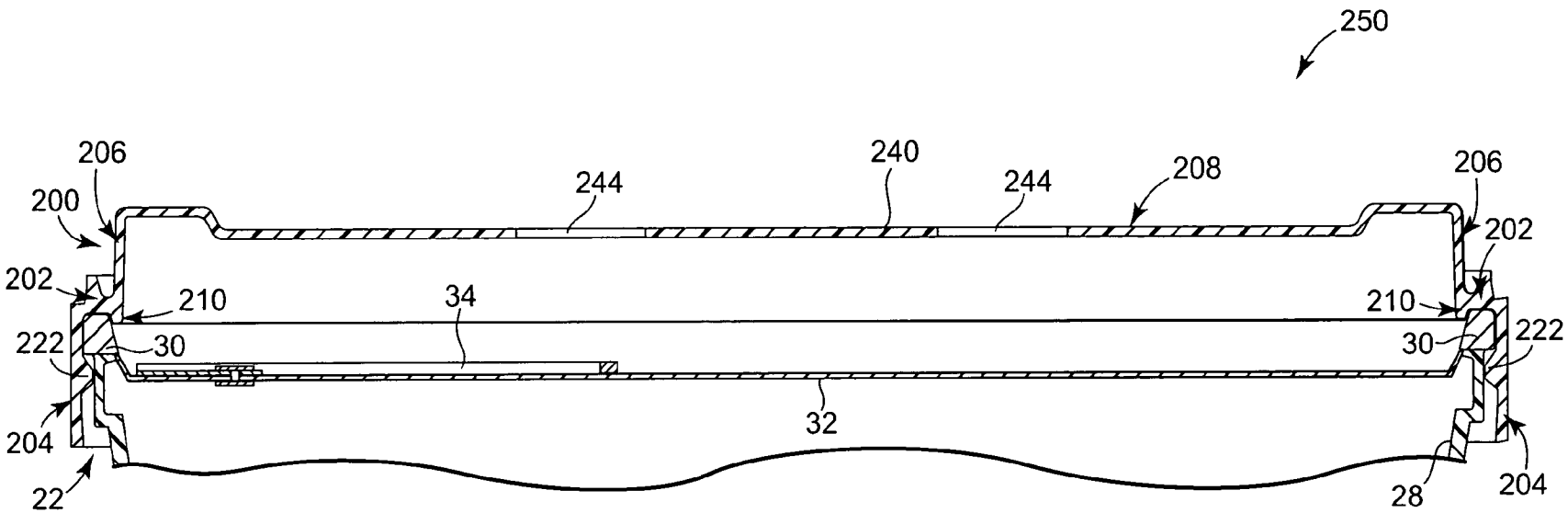
FIG. 10 is a cross-sectional view of the overcap of FIG. 7 assembled to a portion of the container of FIG. 1.

More specifically, in one embodiment, such as when the overcap 200 is formed of polypropylene, upon heating of the microwavable product, the overcap 200 radially expands. Referring to FIG. 10, as the overcap 200 expands, the diameter of the skirt 204 enlarges, which results in the clip surface 226*c* being spaced further from the wall 28 of container 22. As such, the distance R is sufficient such that even after expansion due to microwave heating, the chime 30 is still grasped and maintained within the channel 220 by the clip 222. Additionally referring to FIG. 9B, in one embodiment, in order for the clip 222 to so maintain the chime 30 during and after microwave heating, the distance R, as measured at room temperature, is greater than the expected radial expansion of the overcap 200 during microwave heating. In one example, the distance R is substantially equal to a distance that the chime 30 extends from the remainder of the container 22 as generally illustrated as in FIG. 10. The length of the clip 222 along a portion of the circumference of the skirt 204 is formed to provide sufficient resistance to decrease or prevent inadvertent removal of the overcap 200 while still being configured to be easily disengaged from the chime 30 when so desired by the user. In one embodiment, each clip 222 has a length between about 0.25 inches and about 1.0 inches. In one example, each clip 222 has a length of about 0.65 inches. However, other lengths for the clip(s) 222 are also contemplated.

By more fully securing the overcap 200 to the container 22 even after microwave heating, a user grasping the microwavable product from the microwave is less likely to have an accident in which the overcap 200 is inadvertently removed from the container 22. In particular, due to the specific properties of the clip(s) 222, even if a user removing the microwaveable product from the microwave grasps the microwavable product via the overcap 200 only, it is less likely that the consumable item 38 (FIG. 2) will accidentally be spilled from the container 22.

Figure 9C:
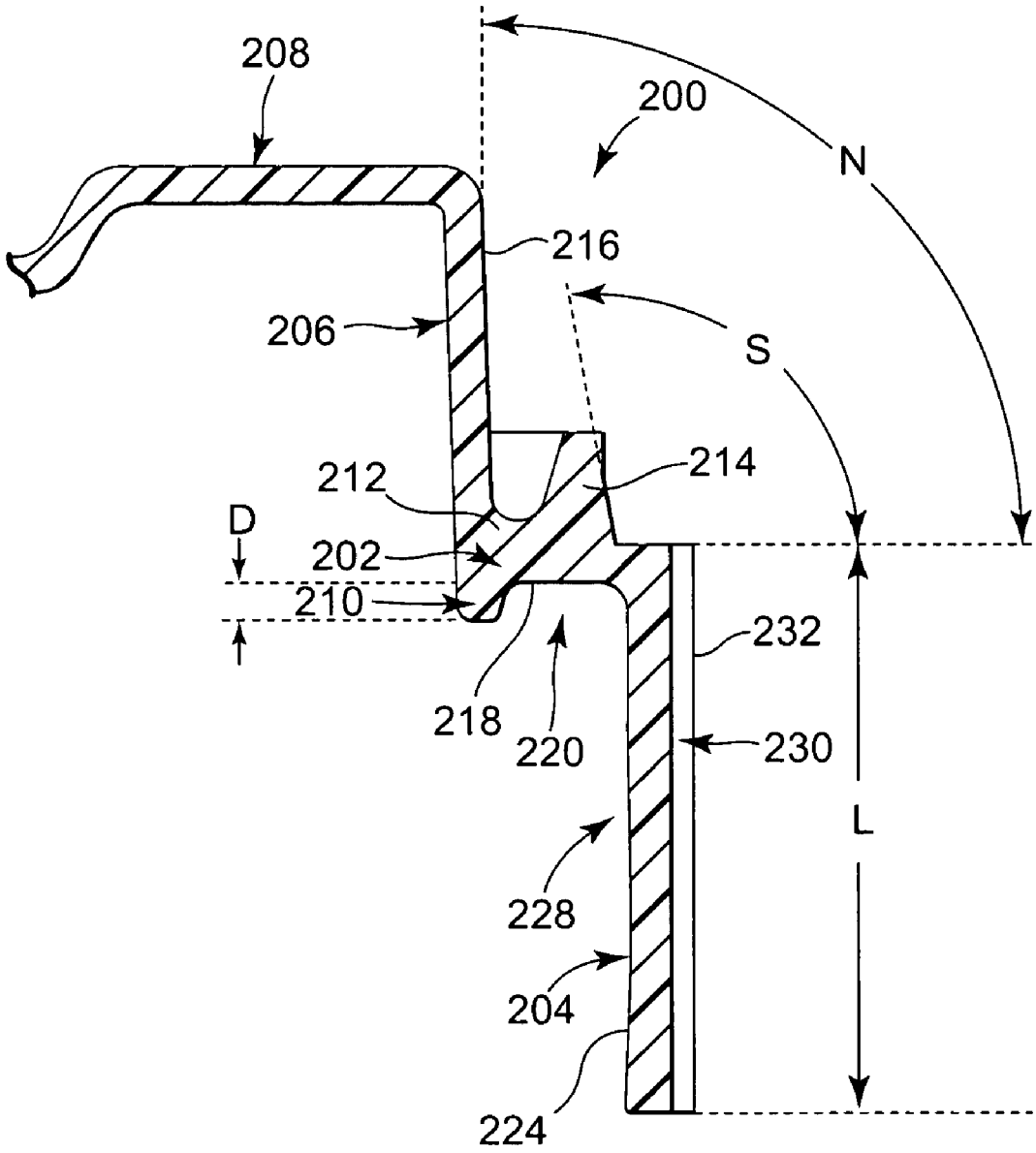
FIG. 9C is an enlarged cross-sectional view of FIG. 8 taken along the line 9C-9C.

Referring to FIGS. 8, 9A, and 9C, in one embodiment, in order to increase the ease of disengaging the clip 222 from the chime 30 (FIG. 10) when desired, the overcap 200 or, more particularly, the skirt 204 further includes areas of reduced thickness 228 spaced from the clip(s) 222. The areas of reduced thickness 228 promote user removal of the overcap 200 from the container 22 by allowing the skirt 204 to more readily stretch and flex or hinge in the area of reduced thickness 228. In one particular embodiment, each area of reduced thickness 228 is spaced along the skirt 204 relative to an adjacent clip 222 at an angle A (FIG. 8) of between about 0° and about 100° as measured from a center of the overcap 200, more preferably, at an angle of between about 30° and about 90°. As such, when a user grasps the skirt 204 near a clip 222 and pulls the skirt 204 away from the container 22, the skirt 204 is configured to flex or hinge at the areas of reduced thickness 228 to more easily disengage the clip 222 from the chime 30. Accordingly, the overcap 200 can more easily be removed from the container 22. In one embodiment, as illustrated with respect to FIGS. 7 and 8, two of the clips 222 and two of the areas of reduced thickness 228 are included. The two clips 222 are diametrically opposed to one another on the skirt 204. The two areas of reduced thickness 228 are also diametrically opposed from the other and are circumferentially-spaced equally between the two clips 222.

Referring to FIGS. 8 and 9C, in one embodiment, the skirt 204 defines a notch 230 configured to at least partially define the area of reduced thickness 228. The notch 230 extends from an exterior skirt surface 232 opposite the interior skirt surface 224. The notch 230 may be substantially triangular to promote flexing of the skirt 204 at or near an interior point of the triangular notch 230. More specifically, the triangular notch 230 promotes a localized concentration of the stresses, which are created when a lifting force is initially applied to the skirt 204 in an attempt to remove the overcap 200 from the container 22 (FIG. 10), at the point of the notch 230. The localization of stresses further facilitates hinging or flexing of the skirt 204 at the notch 230 rather than at other less-desirable portions of the skirt 204 when the overcap 200 is lifted.

In one embodiment, the notch 230 extends a sufficient distance into the skirt 204 to permit flexing of the skirt 204 while not extending into the skirt 204 a distance likely to promote tearing or ripping of the skirt 204 during manufacturing, assembly, or use. Tearing of the skirt 204 would likely at least partially destabilize or lessen the rigidity of the overcap 200, which would impede re-securement of the overcap 200 to the container 22, if desired. Accordingly, in general, the amount of stretch in the skirt 204 provided by the areas of reduced thickness 228 is at least in part dependent upon the amount of lift needed to disengage the clips 22 from the chime 30 (FIG. 2). In one embodiment, the notch 230 extends from the exterior skirt surface 232 through about two thirds of an overall skirt thickness. For example, where the skirt 204 has an overall thickness of 0.03 inches, the notch 230 extends into 0.02 inches of the skirt 204, thereby, leaving the area of reduced thickness 230 with a thickness of 0.01 inch. Although primarily described above as being formed from the exterior skirt surface 232 into the skirt thickness, in one embodiment, a notch may additionally or alternatively be formed from the interior skirt surface 224 toward the exterior skirt surface 232. In one embodiment, the area of reduced thickness 228 is formed by any other suitable method or construction. In other embodiments, the skirt 204 is configured to tear or rip near the notch 230.

In one embodiment, the notch 230 and, therefore, the area of reduced thickness 228 is defined along a substantial entirety of a length L (FIG. 9C) that the skirt 204 extends from the shoulder 202. Formation of the area of reduced thickness 228 to extend a substantial entirety of the length L permits the skirt 204 to be more easily disengaged from the clip 222 upon lifting of the skirt 204 near the clip 222. Accordingly, the level of dexterity required to remove the overcap 200 from the container 22 (FIG. 2) is decreased in comparison to conventional overcaps.

Referring to FIG. 7, in one embodiment, in order to encourage a user to lift the overcap 200 near or, more preferably, directly over a clip 222, an outer surface 240 of the panel 208 or other portion of the overcap 200 includes indicia 242 indicating the location of one of the clip(s) 222 and/or that a user should lift the overcap 200 near that clip 222. The indicia 242 function to encourage effective use of the overcap 200 by the user. For example, lifting of the overcap 200 at a position other than that indicated by the indicia 242 such as a position that is spaced from a clip 222 (for example, over an area of reduced thickness 228) may cause the area of reduced thickness 228 to tear and may not even result in disengagement of at least one clip 222 from the chime 30. In one embodiment, the indicia 242 includes the phrase "LIFT HERE" and/or an arrow or other item pointing toward one clip 222. The indicia 242 may be printed on or formed as raised text extending from the outer surface 240 of the panel 208. Other suitable methods of forming the indicia 242, such as providing stickers with the indicia 242, are also contemplated.

In one embodiment, where the panel 208 defines a plurality of vents 244 similar to vents 82 (FIG. 3A) configured to release steam generated during microwave heating of the packed good article, one or more of the vents 244 is configured to replace or complement the indicia 242. For example, in one embodiment, one of the vents 242*a* is shaped as an arrow pointing toward the clip 222 the user is being encouraged to lift. It should be understood that any number of vents 244 can be formed in the panel 208 to facilitate the venting of the steam formed between the consumable item 38, and that any number of other vents may complement or replace the indicia 242.

Like the overcaps 24, 150 described above the overcap 200 can be constructed of any microwave-compatible material that is sufficiently stiff to thus resist buckling when one or more packaged good articles 20 (FIG. 1) are stacked on top of the overcap 200 and flexible enough to permit the skirt 204, to be lifted away from the chime 30 (FIG. 2) and removing the overcap 200 from the container 22. Exemplary materials for the overcap 200 include, but are not limited to, polymers in general, including polyolefins such as polypropylene and polyethylene, polyesters, polyamides including nylon, filled polymers, poly-coated paper, and paper board. The overcap 200 can be formed in a variety of fashions, and in one embodiment, is an integrally molded body. Alternatively, various component(s) described above can be separately formed and subsequently assembled to form the overcap 200.

FIG. 10 illustrates a central cross-section of the overcap 200 coupled to the container 22 to form a microwavable packaged good article 250. Once again, the container wall 28 terminates in the chime 30 that may or may not be connected to the removable lid 32. The overcap 200 is removably coupled to the container 22 about the chime 30 such that the drip bead 210 projects into the container 22. More particularly, the chime 30 is received within the channel 220 (FIG. 9B) defined by the overcap 200. The skirt 204 extends along an exterior of the container 22, with each clip 222 nesting or nearly nesting against a bottom of the chime 30. In this manner, each clip 222 is said to engage the chime 30 when positioned to maintain the chime 30 within the channel 220. In this position, the interior surface 218 of the shoulder 202 bears against the chime 30. The drip bead 210 and a portion of the interior skirt surface 224 may also contact the chime 30. In one embodiment, the third surface 226*c* of each clip 222 contacts the exterior of the container wall 28 just below the chime 30. In a preferred embodiment, the channel 220 is a continuous annular channel, with the drip bead 210 projecting over the chime 30 and forming a guide surface from an interior of the overcap 200 to an interior of the container 22 and a barrier to the passage of liquids between the overcap 200/container 22 interface.

The overcap 200 is used in a similar manner as the overcap 24, as described above. Additionally referring to FIG. 2, in one embodiment, the overcap 200 is lifted at a point indicated by indicia 242 and/or vents 244 to stretch the area of reduced thickness 228 and to disengage the clip(s) 222 from the chime 30, thereby, removing the overcap 200 from the container 22 (FIG. 2). When the overcap 200 is removed, the lid 32 (FIG. 2) is also removed. Subsequently, the overcap 200 is replaced over the container 22 such that the clips 222 re-engage the chime 30 to prepare the packaged good article 250 for microwave heating.

During microwave heating, the overcap 200 generally expands in an outwardly radial fashion. However, due to the configuration of the clip(s) 222 as described above the overcap 200 is maintained securely on the container 22 via interaction between the clip(s) 222 and the chime 30 of container 22 during and after expansion. In this manner, the overcap 200 is maintained in the proper position such that the annular drip bead 210 continues to direct dripping (e.g., induced by gravity) of at least a portion of the accumulated consumable item 38 from the panel 208 as accumulated during splatter or condensing of the consumable item 38 back into the container 22. In this manner, the boiling consumable item 38 is consistently contained within the container 22/overcap 200 such that seeping or dripping of the consumable item 38 to an exterior of the container 22 is decreased and/or eliminated. Thus the mess and potential handling inconveniences associated with the conventional microwavable packaged good articles is eliminated or at least substantially decreased.

The configuration of the clip(s) 222 of the overcap 200 further contribute to the eliminating or at least decreasing the inconveniences associated with handling the conventional microwavable packaged good articles. In particular, due to the distance each clip 222 extends from the skirt 204, each clip 222 is configured to maintain a handling upon the chime 30 of the container 22 even after expansion due to microwavable heating. As such, it is less likely that a user grabbing the container 22 or the overcap 200 would inadvertently spill the consumable item 38. In addition, the overcap 200 is configured to enhance the structural integrity during normal shipping activities for packaged good articles in a similar manner as described above with respect to the overcap 24.

Figure 11:
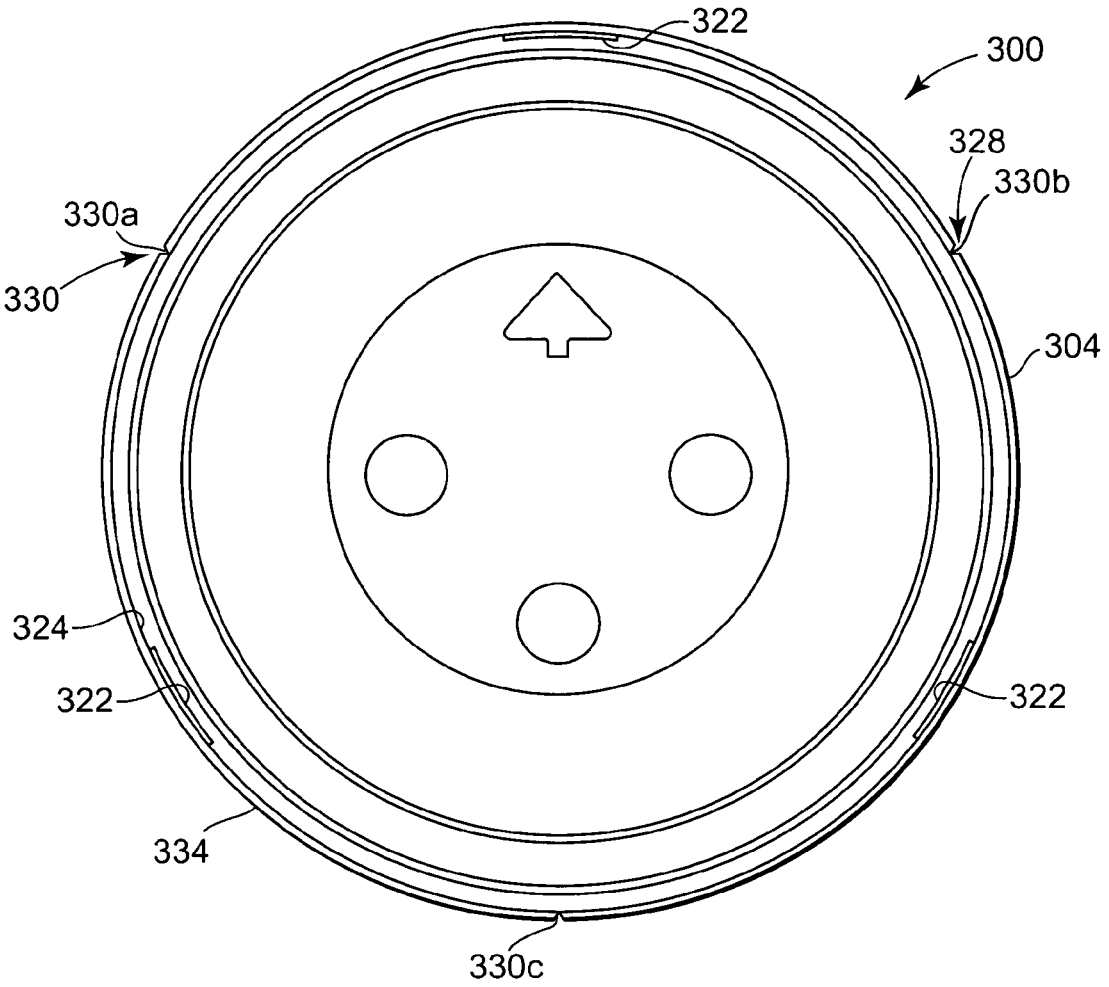
FIG. 11 is a bottom view of one embodiment of an overcap for use with the container of FIG. 1.

Although described, with respect to FIGS. 7 and 8 as spacing the clips 222 diametrically opposed to one another and spacing the areas of reduced thickness 228 diametrically opposed to one another and spaced equally between the clips 222, other numbers and spacing of the areas of reduced thickness 228 and the clips 222 are also acceptable. For example, referring to FIG. 11, in one embodiment, an overcap 300 is provided, which is similar to the overcap 200 except as specifically enumerated below. The overcap 300 defines three clips 322 and three areas reduced thickness 328 similar to the clips 222 and the areas of reduced thickness 228, respectively, described above. In one embodiment, the three clips 322 are circumferentially spaced equally about a skirt 304. More specifically, each of the clips 322 extends from an interior skirt surface 324 of the skirt 304. In one embodiment, as the larger number of clips 322 included in the overcap 300 increases, the forces required to remove the overcap 300 from the respective container 22 (FIG. 2) also increases. In one embodiment, three notches 330 in the skirt 204 at least partially define three areas of reduced thickness 328. Each notch 330 is included in an exterior skirt surface 334 and radially extends inward. Notches 330 are each spaced substantially and circumferentially half way between two of the clips 322.

With the above conventions in mind, lifting of the skirt 304 near one of the clips 322 causes flexing of the skirt 304 at the notches 330 substantially adjacent to the particular clip 322 being lifted. For example, in one embodiment, in which one of the clips 322, generally indicated at 322*a*, as indicated by indicia 340 or vents 342 is to be lifted by the user, only the notches 332*a* and 332*b*, which are adjacent to the clip 322*a* are flexed. The third notch 330*c* positioned diametrically opposed to the clip 322*a* is not substantially flexed, and in one embodiment, is eliminated from the overcap 300. Other configurations of the spacings and number of the clips and notches will be apparent to those of skill in the art. In other embodiments, specific characteristics of the overcaps 24, 150, 200, and 300 described above can be interchanged or used in concert with one another to form an overcap having the particular advantages and/or characteristic desired for use.

The microwaveable packaged good article, and in particular the overcap, of the present invention provides a marked improvement over previous designs. The unsightly, and possibly dangerous, problems associated with undesired product drippage along an exterior of the container is virtually eliminated. Further, the overcap of the present invention is highly robust and maintains its structural integrity under the rigors of most packaging/distribution conditions. In addition, in particular embodiments of the present invention, the overcap is further configured to maintain its structural integrity and retention of the container during microwave heating while still providing the consumer with a packaged good article having an overcap that is easily removable when desired.

Although specific embodiments have been illustrated and described, it will be appreciated by those of ordinary skill in the art that a variety of alternate and/or equivalent implementations may be substituted for the specific overcap embodiments shown and described without departing from the scope of the present invention. This application is intended to cover any adaptations or variations of overcaps for microwaveable packaged good articles. Therefore, it is intended that this invention be limited only by the claims and the equivalents thereof.

What is claimed is:

1. An overcap for selectively covering a container of a microwaveable packaged good article, the overcap comprising:

a panel;

a neck descending from the panel;

a shoulder extending radially outwardly from the neck at a location spaced from the panel; and a continuous skirt descending from the shoulder and spaced radially outwardly from the neck to define a circumferential exterior of the overcap and terminating at a free edge opposite the shoulder, the free edge defining a lower-most end of the overcap opposite the panel, wherein the continuous skirt defines at least two areas of reduced thickness that are circumferentially spaced from one another and formed as continuous, solid surfaces at the lower-most end;

wherein the at least two areas of reduced thickness are configured to allow the skirt to remain continuously intact and flex when the overcap is removed from the container.

2. The overcap of claim 1, wherein each of the at least two areas of reduced thickness includes a notch defined by the skirt.

3. The overcap of claim 1, wherein each of the areas of reduced thickness is defined with a length of material equal to a length the skirt extends from a remainder of the overcap to the lower-most end.

4. The overcap of claim 1, wherein one of the areas of reduced thickness is positioned on the skirt to be diametrically opposite the other one of the areas of reduced thickness on the skirt.

5. The overcap of claim 1, further comprising:

at least two clips extending radially inward from the skirt and being spaced from one another along the skirt, wherein each of the at least two clips is configured to interact with a chime of the container to facilitate coupling of the overcap to the container.

6. The overcap of claim 5, wherein the overcap is configured for use with a container including a base and a continuous wall extending from the base and terminating in the chime.

7. The overcap of claim 6, wherein the chime extends a first distance from the continuous wall, and each of the at least two clips extends from the skirt a second distance substantially equal to the first distance.

8. The overcap of claim 5, wherein the at least two clips are positioned along the skirt substantially diametrically opposite one another.

9. The overcap of claim 5, wherein the at least two clips include three clips substantially equally spaced about the perimeter of the skirt.

10. The overcap of claim 5, wherein each of the at least two areas of reduced thickness is positioned between two of the at least two clips.

11. The overcap of claim 10, wherein each of the at least two areas of reduced thickness is circumferentially spaced substantially half way between two adjacent ones of the at least two clips.

12. The overcap of claim 1, wherein the neck descends from the shoulder to terminate in a drip bead configured to extend into the container upon assembly.

13. The overcap of claim 1, wherein the panel includes indicia indicating the position of one of the at least two clips and instructing a user to lift the overcap near the indicated one of the at least two clips.

14. The overcap of claim 1, wherein the panel defines at least one vent shaped as an arrow pointing toward one of the at least two clips.

15. A microwaveable packaged good article comprising:

a container including:

a base, a continuous wall extending from the base and terminating in a chime, the continuous wall defining a containment region and the chime, defining an opening to the containment region; and an overcap removably coupled to the container and including:

a panel, a neck extending from the panel, and a skirt radially spaced from the neck, defining at least two areas of reduced thickness spaced from one another and terminating at a free edge opposite the neck, wherein the skirt is continuous across the at least two areas of reduced thickness and the at least two areas of reduced thickness are configured to allow the skirt to remain continuously intact and flex when the overcap is removed from the container;

wherein the packaged good article is configured to provide an assembled state in which the overcap is coupled to the container with the skirt extending about an exterior of the continuous wall and the neck locating the panel outside of the containment region and above the free edge.

16. The microwaveable packaged good article of claim 15, wherein each area of reduced thickness is at least partially defined by a triangular notch.

17. The microwaveable packaged good article of claim 15, wherein the at least two areas of reduced thickness are positioned on the skirt substantially diametrically opposite one another.

18. The microwaveable packaged good article of claim 15, wherein the skirt additionally defines at least two clips spaced along the skirt from each other and each of the at least two areas of reduced thickness, and wherein each of the at least two clips is configured to selectively engage the chime of the container.

19. The microwaveable packaged good article of claim 16, wherein each of the at least two areas of reduced thickness is circumferentially spaced along the skirt substantially half way between two of the at least two clips, and wherein flex of the at least two areas of reduced thickness facilitates disengagement of the at least two clips from the chime of the container.

20. The microwaveable packaged good article of claim 15, further comprising:

a removable lid secured to the chime.

21. The microwaveable packaged good article of claim 15, further comprising:

a consumable item contained in the container.

22. A method of microwave heating a packaged good article comprising:

providing a container defining a continuous wall terminating in a chime, the container containing a consumable item;

securing an overcap to the container, the overcap including:

a panel;

a neck descending from the panel; and a shoulder extending radially outwardly from the neck at a location spaced from the panel;

a skirt descending from the shoulder and radially spaced from the neck to define a circumferential exterior of the overcap and terminating at a free edge opposite the shoulder, the free edge defining a lower-most end of the overcap opposite the panel, wherein the skirt defines at least two areas of reduced thickness spaced from one another, wherein the at least two areas of reduced thickness are configured to allow the skirt to flex when the overcap is removed from the container;

microwave heating the packaged good article to boil the consumable item and to radially expand the overcap; and removing the overcap, including the skirt, from the container including flexing and stretching the skirt at the at least two areas of reduced thickness, wherein portions of the skirt at immediately opposite sides of each of the two areas of reduced thickness, respectively, remain contiguously attached by the corresponding area of reduced thickness with flexing of the overcap.

23. The method of claim 22, wherein the overcap further includes at least two clips extending from radially inward from the skirt and being circumferentially spaced from one another and the at least two areas of reduced thickness along the skirt, each of the at least two clips being configured to maintain the chime of the container within a channel defined between the neck, the skirt, and the at least two clips of the overcap.

24. The microwaveable packaged good article of claim 15, wherein the lower-most end defines a circular ring having an inner diameter and an outer diameter, and further wherein the outer diameter of the lower-most end is lesser at the areas of reduced thickness as compared to the outer diameter of the lower-most end at immediately opposite sides of each of the areas of reduced thickness.

25. The overcap of claim 1, further comprising:

a continuous rib structure radially spaced from the neck and defining a circumferential guide surface formed as a continuous solid surface at an upper-most end to facilitate stacking with a second overcap.

26. The microwaveable packaged good article of claim 15, wherein the neck descends from the panel, and wherein the overcap further includes a shoulder extending radially outwardly from the neck at a location spaced from the panel, the skirt descending from the shoulder and spaced radially outwardly from the neck, and further wherein the free edge defines a lower-most end of the overcap opposite the panel.

* * * * *